US008341813B2

(12) United States Patent
Foss et al.

(10) Patent No.: US 8,341,813 B2
(45) Date of Patent: Jan. 1, 2013

(54) HINGE LOCATOR DEVICE

(75) Inventors: Lyndal Allen Foss, Wichita, KS (US); Robert Gerald Clem, Mulvane, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 622 days.

(21) Appl. No.: 12/336,059

(22) Filed: Dec. 16, 2008

(65) Prior Publication Data

US 2010/0146732 A1 Jun. 17, 2010

(51) Int. Cl.
*B21D 53/40* (2006.01)

(52) U.S. Cl. ..... 29/11

(58) Field of Classification Search ..... 29/11; 16/254; 33/286, 293

See application file for complete search history.

(56) References Cited

U.S. PATENT DOCUMENTS 4,039,138 A * 8/1977 Einhorn ..... 248/497
2008/0134528 A1* 6/2008 Dickinson ..... 33/293

* cited by examiner

*Primary Examiner* — David Bryant
*Assistant Examiner* — Moshe Wilensky
(74) *Attorney, Agent, or Firm* — Hovey Williams LLP

(57) ABSTRACT

A locator device for locating the centerline of a plurality of piano hinge segments without the use of hard tooling includes a target support element, a pair of targets supported on opposite ends of the target support element, and a locator element for locating the target support element relative to hinge pin holes so that the targets are equally spaced from the hinge pin holes. The targets may be reflective-type targets used in laser targeting systems, photogrammetry targets used in digital photogrammetry locating systems, or other known targets.

11 Claims, 4 Drawing Sheets

HINGE LOCATOR DEVICE

BACKGROUND

The present invention relates to hinge locator devices for assisting in the mounting of hinges. More particularly, the invention relates to a locator device for locating the centerline of a piano hinge.

Piano hinges, which are sometimes called continuous hinges, have long, narrow hinge leaves or plates and a long continuous hinge pin that runs substantially the entire length of the hinge joint. Piano hinges are used in many applications that require support of heavy or large doors such as aircraft cargo doors. Piano hinges are also often used in applications that do not have room for wide hinge leaves and/or when it is desired to have less prominent hinge leaves.

Because it is difficult to manufacture, transport, and install extremely long hinges, many piano hinges include a number of shorter hinge segments that are aligned end-to-end on a door or doorframe. Those skilled in the art will appreciate that the hinge segments must be precisely aligned or else the associated hinge pin will not fit through all the hinge segments. Known hinge segment alignment methods use hard tooling that is expensive to manufacture and difficult to use. Moreover, such tooling is typically configured for a specific hinge size and type, thus necessitating different tooling for every different size and type of hinge.

Accordingly, there is a need for an improved hinge locator that overcomes the limitations of the prior art.

SUMMARY

The present invention solves the above-described problems and provides a distinct advance in the art of hinge locator devices. More particularly, embodiments of the present invention provide a hinge locator that can be used to locate the centerline of a piano hinge or a plurality of piano hinge segments without the use of hard tooling.

One embodiment of the invention is a locator device comprising a target support element; a pair of targets supported on opposite ends of the target support element; and a locator element for locating the target support element on a hinge. In one embodiment, the target support element is a cylindrical bar with holes formed in its ends. The targets are supported in the holes so they are equidistant from the center of the bar. The targets may be reflective-type targets used in laser targeting systems, photogrammetry targets used in digital photogrammetry locating systems, or any other known targets or devices used in positioning or locating systems. In one embodiment, the locator element may be a post, roughly the same diameter as the hinge pin, extending perpendicularly from the center of the target support element. The post fits within one of the pin holes of the hinge to support the targets an equal distance from opposite sides of the pin. In another embodiment, the locator element may be a central flange formed in the center of the target support element through which a pin may be threaded to support the targets on opposite sides of the pin.

Once the locator device is attached to a hinge as described above, a targeting system may locate the centerline of the hinge by locating the positions of the two targets and calculating the mid-point therebetween. The centerline of a hinge or hinge segment is preferably determined with two of the locator devices, one attached to a fore end and another attached to an aft end.

These and other important aspects of the present invention are described more fully in the detailed description below.

The particular embodiments of the hinge locator device described herein may be replaced with other embodiments without departing from the scope of the invention.

BRIEF DESCRIPTION OF THE DRAWING FIGURES

Embodiments of the present invention are described in detail below with reference to the attached drawing figures, wherein.

Figure 1:
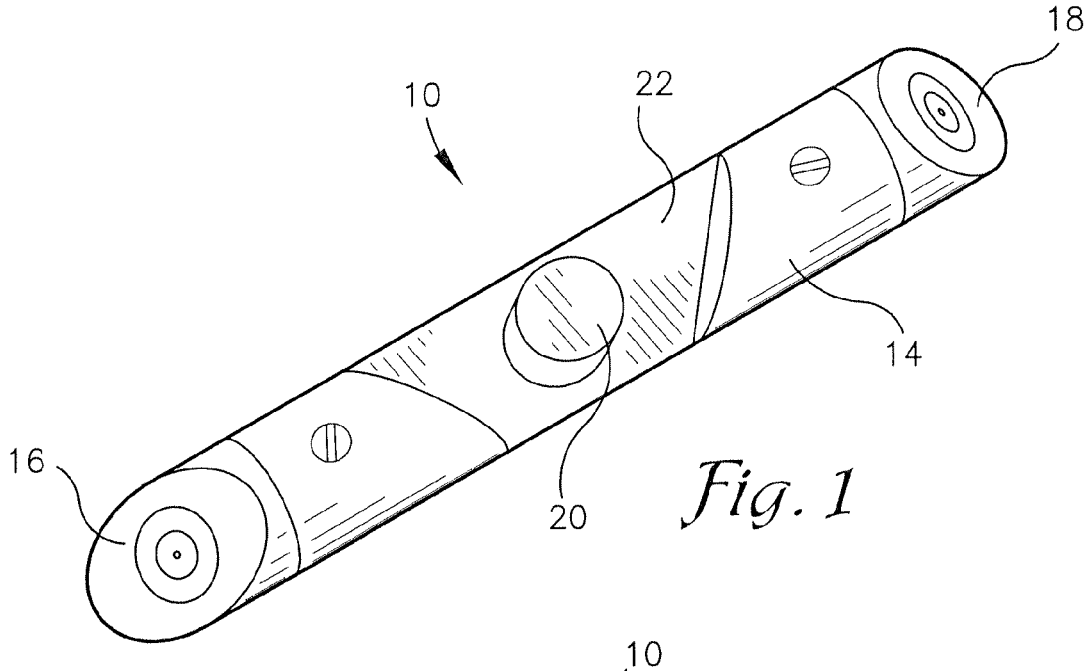
FIG. 1 is a perspective view of a locator device constructed in accordance with a first embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 5:
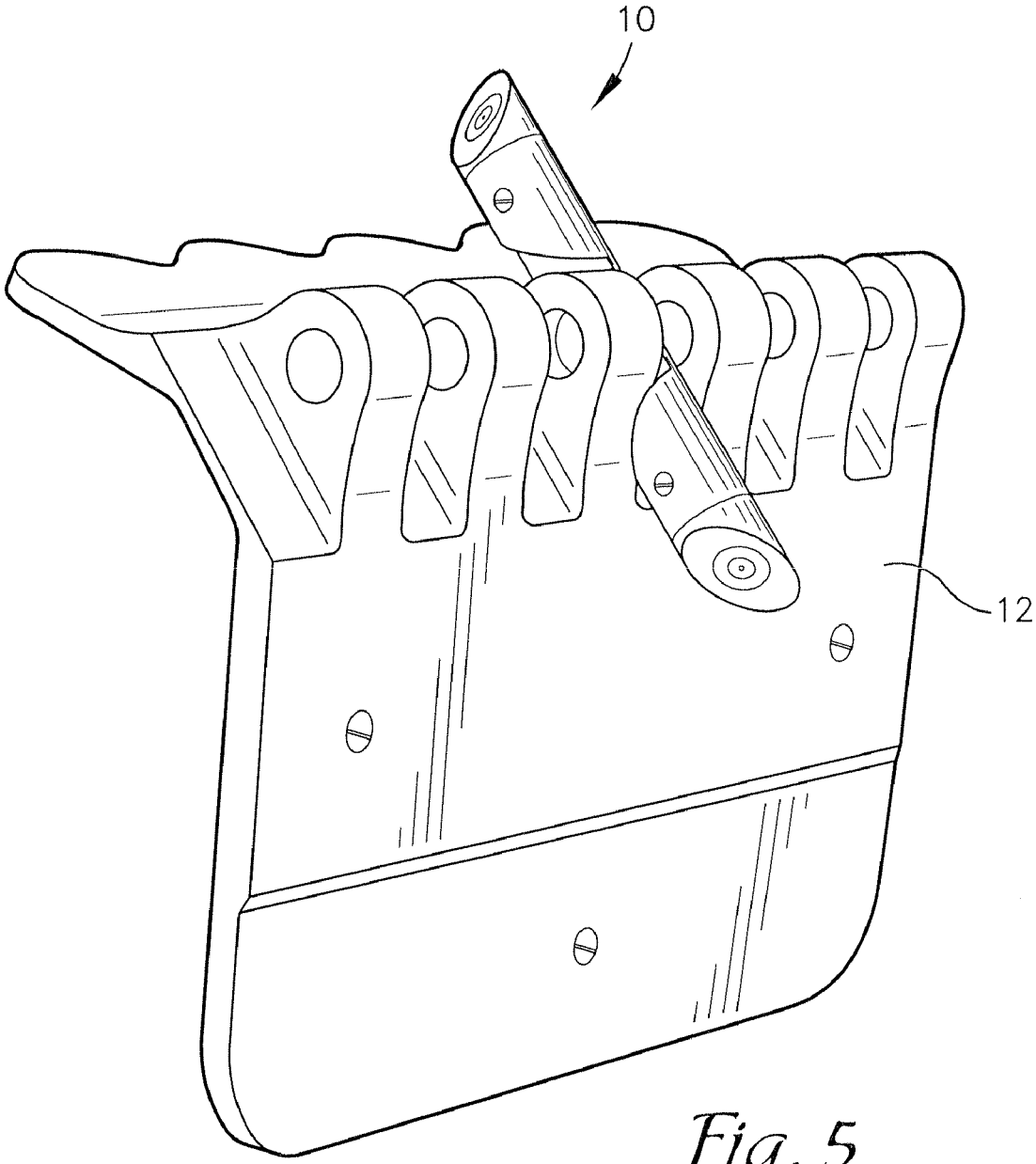
FIG. 5 is a perspective view showing the locator device positioned within a piano hinge segment.
Figure 6:
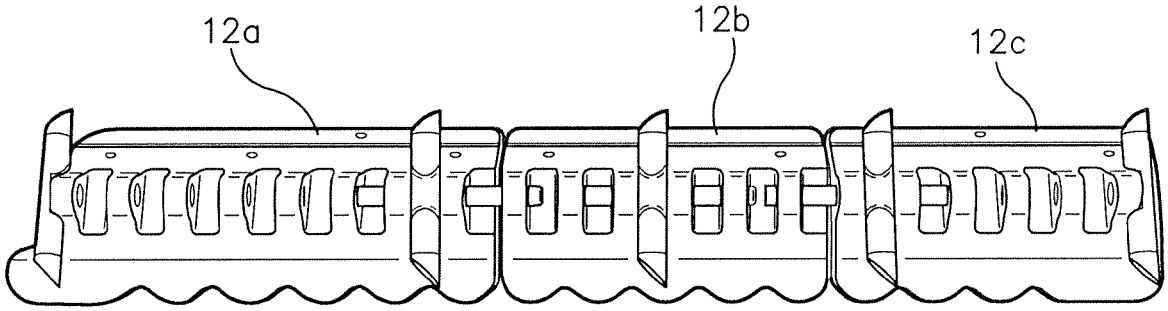
FIG. 6 is a top view showing a plurality of the locator devices used to locate the centerline for a plurality of aligned piano hinge segments.
Figure 7:
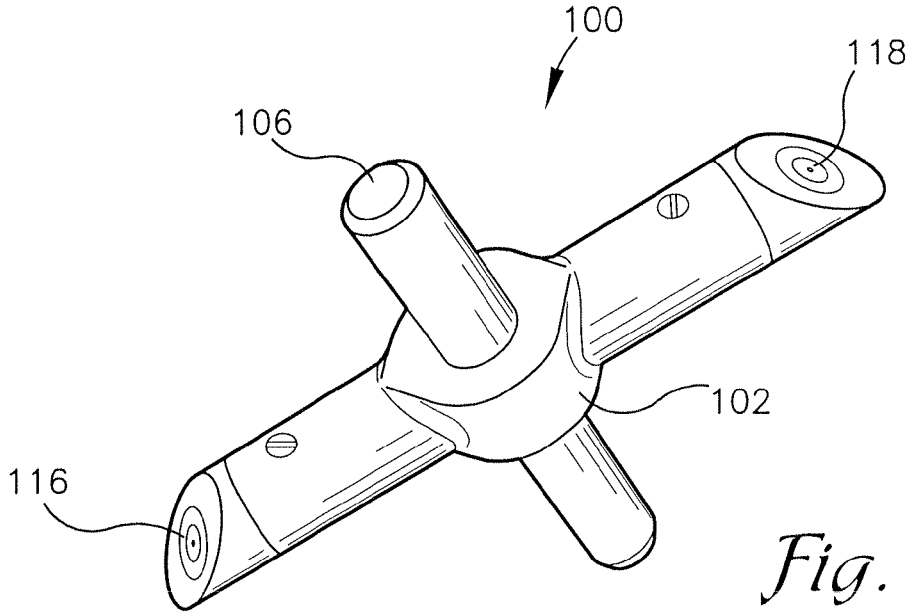
FIG. 7 is a perspective view of a locator device constructed in accordance with a second embodiment of the invention.
Figure 8:
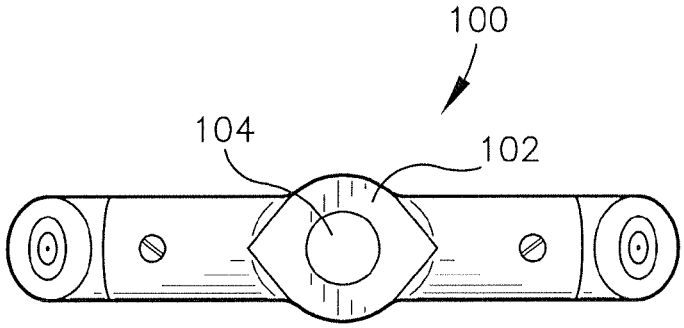
FIG. 8 is a top view of the locator device of FIG. 7.
Figure 9:
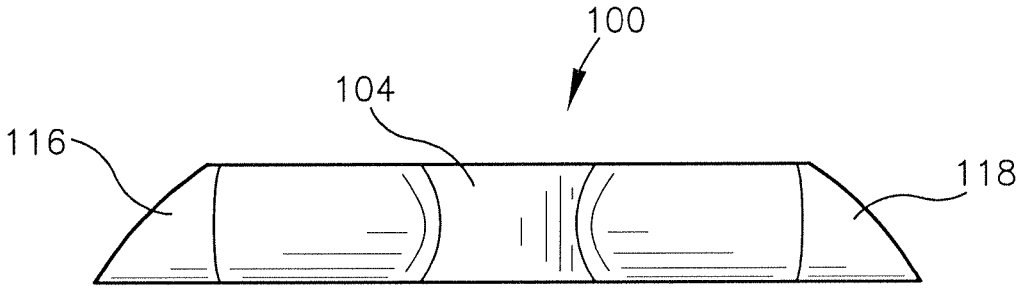
FIG. 9 is a vertical sectional view of the locator device of FIG. 7.
Figure 10:
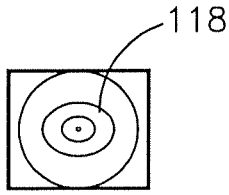
FIG. 10 is an end view of one end of the locator device of FIG. 7.
Figure 11:
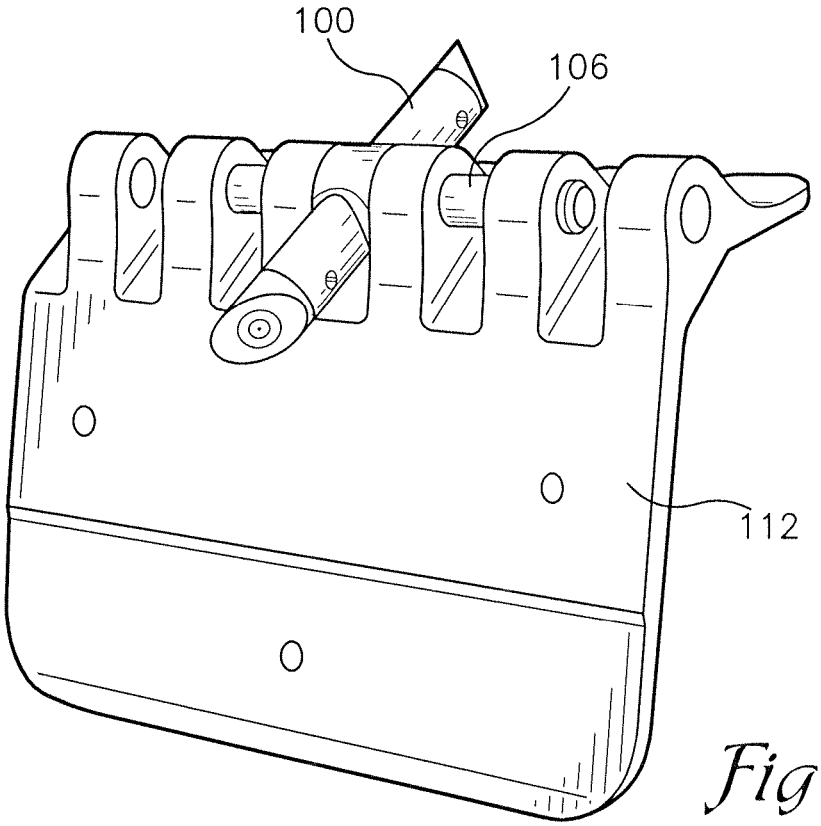
FIG. 11 is a perspective view showing the locator device positioned within a piano hinge segment.

Turning now to the drawing figures, and initially FIGS. 1-6, a hinge locator device 10 constructed in accordance with a preferred embodiment of the invention is illustrated. As shown in FIG. 5, the hinge locator device 10 can be used to assist with the mounting of a hinge or hinge segment 12 on a door, doorframe, or other item. The hinge locator device 10 may also be used to locate the centerline for a plurality of piano-type hinge segments 12*a*, 12*b*, 12*c* as shown in FIG. 6 so that the hinge segments may be properly aligned.

Figure 2:
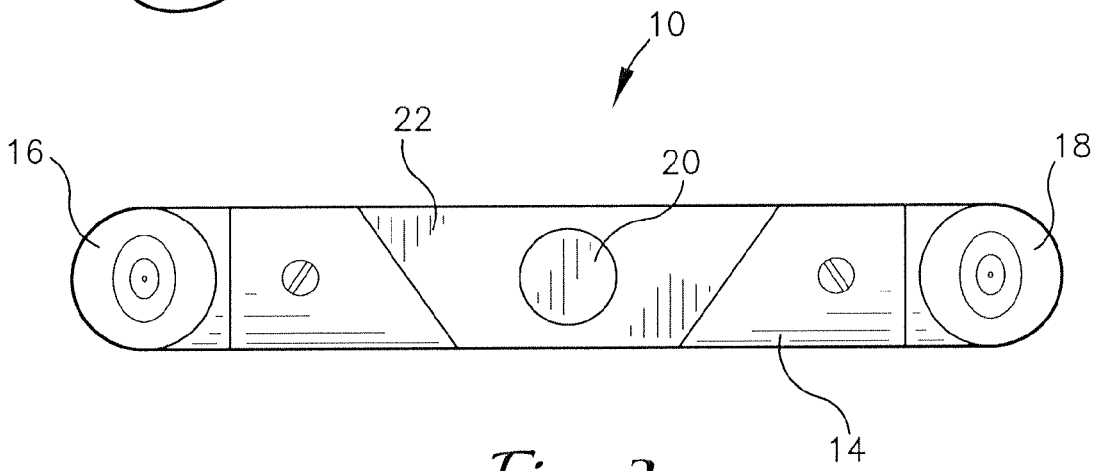
FIG. 2 is a top view of the locator device of FIG. 1.
Figure 3:
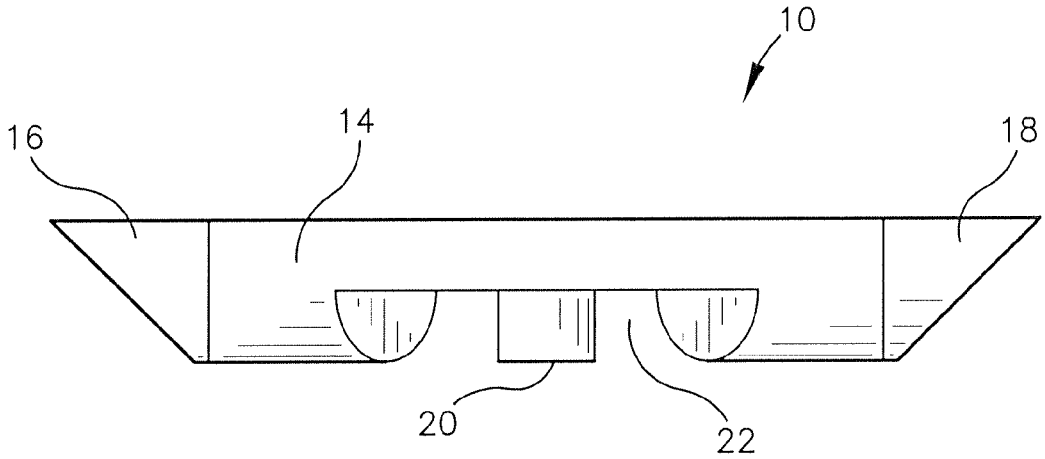
FIG. 3 is a side view of the locator device of FIG. 1.
Figure 4:
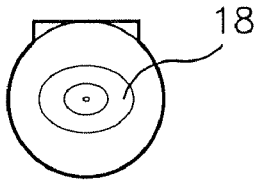
FIG. 4 is an end view of one end of the locator device of FIG. 1.

Referring to FIGS. 1-3, an exemplary embodiment of the locator device 10 comprises a target support element 14; a pair of targets 16, 18 supported on opposite ends of the target support element 14; and a locator element 20 for locating the target support element 14 on the hinge 12 or one of the hinge segments 12*a-c*.

In more detail, the target support element 14 is preferably a heat-treated machined aluminum cylindrical bar with high tolerance holes on each end for receiving and supporting the targets 16, 18. One embodiment of the bar is approximately 2.375" long and has ¼" diameter target holes. The center of the target support element includes a recessed region 22 that permits the support element to fit between adjacent knuckles on a hinge as shown in FIG. 5.

The targets 16, 18 are supported in the holes on the ends of the target support element 14 so that they are equidistant from the center of the target support element. The targets may be reflective-type targets used in laser targeting systems, photogrammetry targets used in digital photogrammetry locating systems, or any other known targets or devices used in positioning or locating systems. In another embodiment, the targets 16, 18 may be integrally formed on the ends of the target support element 14 rather than being separate components.

The locator element 20 attaches the target support element 14 to the hinge 12 or one of the hinge segments 12*a-c* and holds it in place during a targeting procedure. The locator element is preferably received within at least one pin hole of the hinge so that the targets are equally spaced from the centerline of the hinge. In the exemplary embodiment of FIGS. 1-6, the locator element 20 is a cylindrical post extending perpendicularly from the mid-point of the target support element 14 within the recessed region 22. The post has a diameter approximately equal to the diameter of the hinge pin. For example, the post may have a diameter of 0.250" or 0.375" to accommodate standard-sized hinges having the same diameter hinge pins. However, the particular diameter of the post can be sized to accommodate any size and/or type of hinge.

To locate the centerline of the hinge 12 or one of the hinge segments 12*a-c,* the locator element 20 is placed within one of the hinge's pin holes as shown in FIGS. 5 and 6. A targeting system, such as a laser targeting system or a photogrammetry targeting system is then used to determine the precise locations of the two targets 16, 18. The centerline of the hinge is then calculated to be the mid-point between the two targets.

More than one locator device 10 may be used to more precisely locate the centerline of the hinge 12 or one of the hinge segments 12*a-c*. For example, FIG. 6 illustrates multiple adjacent hinge segments 12*a-c* of a piano hinge, wherein one locator device is attached to the fore end and another locator device is attached to the aft end of each hinge segment to locate the centerline of that hinge segment. The above-described targeting procedure is then performed to locate the precise locations of all of the targets to accurately determine the centerline of all of the hinge segments.

Once the centerline of a hinge segment or hinge is determined as described above, this information may be used to shim the hinge, drill pilot holes, drill mounting holes, or provide any other assistance in locating or mounting the hinge segments on a door, doorframe, or any other structure.

FIGS. 7-11 illustrate a hinge locator device 100 constructed in accordance with another embodiment of the invention. The hinge locator 100 is similar to the hinge locator 10 shown in FIGS. 1-6 except that the locator post 20 and recessed area 22 are replaced with a central locator flange 102 having a pin hole 104 therethrough. A pin 106, roughly the same diameter as the hinge pin, can be inserted through the locator flange 102 and one or more pin holes of a hinge 112 to locate and support the locator device 100 on the hinge.

Although the invention has been described with reference to the embodiments illustrated in the attached drawing figures, it is noted that equivalents may be employed and substitutions made herein without departing from the scope of the invention as recited in the claims. For example, the locator devices 10 and 100 may be formed of different materials and in different shapes and sizes than those disclosed herein without departing from the scope of the appended claims.

Having thus described the preferred embodiment of the invention, what is claimed as new and desired to be protected by Letters Patent includes the following:

1. A locator device for assisting with the mounting of a hinge, the locator device comprising:

an elongated target support element having a target on each of its ends, wherein a length of the elongated target support element extends between the ends; and a locator element configured for interfacing with a hinge pin hole of the hinge, thereby locating the target support element relative to the hinge so that the targets are positioned on opposite sides of the hinge, wherein the target support element has a recessed region sized and shaped to fit between adjacent knuckles on a hinge, wherein the locator element is a post extending from the mid-point of the recessed region of the target support element and sized and shaped to be received within at least one pin hole of the hinge, wherein the recessed region has a substantially tapered width.

2. The locator device as set forth in claim 1, wherein the targets are reflective targets used in laser targeting systems.

3. The locator device as set forth in claim 1, wherein the targets are photogrammetry targets used in digital photogrammetry locating systems.

4. The locator device as set forth in claim 1, wherein the target support element is an elongated bar with holes formed in its ends for receiving and supporting the targets.

5. The locator device as set forth in claim 1, wherein the targets are integrally formed on the ends of the target support element.

6. The locator device as set forth in claim 1, wherein the hinge is one or more piano-type hinge segments.

7. A locator device for assisting with the mounting of a hinge, the locator device comprising:

a target support element;

a pair of reflective or photogrammetry targets supported on opposite ends of the target support element, wherein a length of the elongated target support element extends between the opposite ends; and a locator element configured for locating the target support element relative to hinge pin holes in the hinge so that the targets are equally spaced from the hinge pin holes and the targets and locator element are laterally aligned, wherein the target support element has a recessed region sized and shaped to fit between adjacent knuckles on a hinge, wherein the locator element is a post extending from the mid-point of the recessed region of the target support element and sized and shaped to be received within at least one pin hole of the hinge, wherein the recessed region has a substantially tapered width.

8. The locator device as set forth in claim 7, wherein the target support element is an elongated bar with holes formed in its ends for receiving and supporting the targets.

9. The locator device as set forth in claim 7, wherein the targets are integrally formed on the ends of the target support element.

10. The locator device as set forth in claim 7, wherein the locator element is a post extending perpendicularly from the mid-point of the target support element.

11. The locator device as set forth in claim 7, wherein the hinge is one or more piano-type hinge segments.

* * * * *